US011384320B2

(12) United States Patent
Farrell

(10) Patent No.: US 11,384,320 B2
(45) Date of Patent: Jul. 12, 2022

(54) SYNTHETIC DETERGENT BARS

(71) Applicant: Conopco, Inc., Englewood Cliffs, NJ (US)

(72) Inventor: Terence James Farrell, Sandy Hook, CT (US)

(73) Assignee: CONOPCO, INC., Englewood Cliffs, NJ (US)

( * ) Notice: Subject to any disclaimer, the term of this patent is extended or adjusted under 35 U.S.C. 154(b) by 176 days.

(21) Appl. No.: 16/466,482

(22) PCT Filed: Nov. 28, 2017

(86) PCT No.: PCT/EP2017/080734
§ 371 (c)(1),
(2) Date: Jun. 4, 2019

(87) PCT Pub. No.: WO2018/104115
PCT Pub. Date: Jun. 14, 2018

(65) Prior Publication Data

US 2020/0063075 A1 Feb. 27, 2020

(30) Foreign Application Priority Data

Dec. 6, 2016 (EP) ..... 16202538

(51) Int. Cl.

| | |
|---|---|
| ***C11D 17/00*** | (2006.01) |
| ***C11D 10/04*** | (2006.01) |
| ***C11D 1/94*** | (2006.01) |
| ***C11D 3/37*** | (2006.01) |
| ***C11D 9/00*** | (2006.01) |
| *C11D 1/28* | (2006.01) |
| *C11D 1/90* | (2006.01) |

(52) U.S. Cl.
CPC ..... *C11D 10/042* (2013.01); *C11D 1/94* (2013.01); *C11D 3/3707* (2013.01); *C11D 9/005* (2013.01); *C11D 17/006* (2013.01); *C11D 1/28* (2013.01); *C11D 1/90* (2013.01)

(58) Field of Classification Search
CPC ..... C11D 10/042; C11D 1/94; C11D 3/3707; C11D 17/006
See application file for complete search history.

(56) References Cited

U.S. PATENT DOCUMENTS

| | | | | |
|---|---|---|---|---|
| 3,376,229 | A | 4/1968 | Haas | |
| 3,951,842 | A | 4/1976 | Prince et al. | |
| 5,520,840 | A | 5/1996 | Massaro | |
| 5,540,854 | A | 7/1996 | Fair et al. | |
| 5,683,973 | A | 11/1997 | Post et al. | |
| 5,786,312 | A | 7/1998 | Post et al. | |
| 5,795,852 | A | 8/1998 | He et al. | |
| 5,985,808 | A * | 11/1999 | He | C11D 1/94 510/152 |
| 6,057,275 | A | 2/2000 | Fair et al. | |
| 6,251,843 | B1 * | 6/2001 | Chambers | C11D 3/1213 570/154 |
| 6,342,470 | B1 * | 1/2002 | Aronson | C11D 17/006 510/141 |
| 2010/0069277 | A1 * | 3/2010 | McFann | C11D 13/14 510/152 |

FOREIGN PATENT DOCUMENTS

| | | |
|---|---|---|
| WO | WO9512382 | 5/1995 |
| WO | WO9937744 | 7/1999 |

OTHER PUBLICATIONS

IPRP2 in PCTEP2017080734; dated Mar. 14, 2019.
Search Report and Written Opinion in EP16202538; dated Jun. 14, 2017.
Search Report and Written Opinion in PCTEP2017080734 ; dated Feb. 21, 2018.
Written Opinion 2 in PCTEP2017080734; dated Oct. 16, 2018.

* cited by examiner

*Primary Examiner* — Necholus Ogden, Jr.
(74) *Attorney, Agent, or Firm* — Krista A. Kostiew

(57) ABSTRACT

A bar composition comprising: a) 10%-60% synthetic (non-soap) surfactant; b) 0%-50% fatty acid and soap wherein total fatty acid soap is less than 60% of total synthetic surfactant; c) 6.8%-54% water-soluble structurant, selected from • polyalkylene oxides having MW 1,500-10,000, • PEO-PPO blockcopolymers, wherein the water soluble structurant has a melting point of 40-100° C. and further comprises polyalkylene oxides having MW 50,000-500,000, 1-5 wt %; d) 0.1%-4.8% alkali metal isethionate; e) 2.7%-13.5% water, wherein the sum of water, alkali metal isethionate and water-soluble structurant is 10%-60%, wherein based on the total amount of water, alkali metal isethionate and said water-soluble structurant, • water is present 4-27%, • alkali metal isethionate is present less than 8%, • water-soluble structurant is present 68-90%. Use of the composition for eliminating efflorescence.

17 Claims, No Drawings

SYNTHETIC DETERGENT BARS

CROSS REFERENCE TO RELATED APPLICATIONS

The present application is a U.S. National Phase Application under 35 U.S.C. § 371 of International Application No. PCT/EP2017/080734, filed on Nov. 28, 2017, which claims priority to European Patent Application No. 16202538.1, filed on Dec. 6, 2016, the contents of which are incorporated herein in their entireties.

FIELD OF THE INVENTION

The invention relates to synthetic detergent bars (so-called "syndet" bars) and particularly to synthetic bars structured with water-soluble structurants (e.g., polyalkylene glycol).

BACKGROUND OF THE INVENTION

Bars may be classified into various categories. Conventional soap bars, for example, typically comprise about 60% to 80% fatty acid soap. Fatty acid soaps are selected to provide a balance of soluble and insoluble soaps which provide the required functional properties, as regards lather formation and bar structure. Conventional soap bars are manufactured by milling, plodding and stamping a semi-solid mass of soap and other components.

Another category are bars which contain a mixture of soap and synthetic detergent where the amount of soap may be less than the amount of synthetic detergent, but is nevertheless still a significant contributor to the content of the bar. In such bars, as in conventional soap bars, the content of soap, especially the insoluble soap, contributes to the structure and physical properties of the bar.

Synthetic detergent bars (also known as "syndet bars"), the subject of the present invention, are bars in which there is no soap or amount of soap is less than the detergent active surfactant present. Generally, such bars contain a substantial proportion of material which is not a detergent, but which serves to give structure to the bar.

Although syndet bars may contain water-insoluble structuring materials such as starch and kaolin (as well as plasticizers such as stearic acid and cetyl alcohol), it has previously been found that using water-soluble structurants having a melting point in the range of 40° C. to 100° C. (e.g., polyethylene glycol, or "PEG") can be advantageous. For example, polyethylene glycols are advantageous because they provide a water-soluble matrix that can still be extruded while simultaneously providing a means to significantly reduce a formulation's total amount of surfactant (e.g., alkali metal isethionate).

Traditional bar material, such as sodium cocoyl isethionate, is unique in that it can provide a formulation with a structure that can be extruded on a commercial scale but also provide a pleasant experience when used (lathered). When focusing on formulations designed to be clinically milder than traditional syndet bars, total amounts of surfactant, however should be significantly reduced. If the surfactant is replaced by fatty material, the structure of the bar may be such as to render the reduced amounts of surfactant insufficient and lathering may be poor. Reducing surfactant and replacing said surfactant with water-soluble structurants, such as PEGs allows for a pleasant end user experience to be maintained (for example, lather is maintained).

Even though low active, PEG based formulations can be extruded and maintain good lather, because of the physical interactions between PEGs, surfactants, co-surfactants and water, the formulations still tend to be physically softer than traditional syndets. One means of "hardening" soft formulations (as is well known in the art, especially for fatty acid soaps) is to include/increase electrolyte levels. For syndets, sodium isethionate is a preferred electrolyte because it is used in the process of sodium cocoyl isethionate production and is considered part of the "moisturization package".

Thus as noted, electrolyte (e.g., sodium isethionate or salt NaCl) is typically incorporated into bar formulations (especially low active syndet formulation which have more non-soap surfactant than soap), and which comprise polyalkylene glycol, to enhance firmness and robustness during manufacture.

Unfortunately, the introduction of electrolyte to harden the bar, particularly to harden syndet bars (particularly bars comprising synthetic, non-soap surfactant, such as metal alkali isethionate, and wherein non-soap surfactant is greater than 50% of the surfactant system) which are structured with water-soluble structurant has been found to introduce stability issues. Specifically, it has been found that, upon storage, there is formation of crystalline solids on the surface of the bars, a phenomenon referred to as efflorescence. While this does not impact bar performance, it is visually unappealing and unacceptable from a consumer perspective.

Applicants have now found synthetic detergent bars wherein, when ranges of three particular components in the final formulation are defined, the problem of efflorescence in these types of bars (syndet bars structured with polyethylene glycol and comprising alkali metal isethionate as hardening agent) can be eliminated (defined by the absence of visible crystals on the bar surface).

The range of these three components in the final bar is calculated by multiplying the total amount of the three (as noted in the paragraph below, this is selected to be such that the final desired formulation represents the sum of three having a range between 10 and 60% multiplied by the factor; that is, the formulator can select where in the final range they choose to be and can readily calculate the specific amount) by ranges of each of the three, wherein the ranges by which the total is multiplied is experimentally determined. Specifically, applicants have determined an area or range of stability and homogeneity visually observed from a ternary mixture of the three which defines the range for multiplying.

The experimentally determined ranges are thus used as a type of tool to determine the amounts of each of the three components in the final bar composition. In performing the calculation, the sum of the three components in the final bar which is multiplied by the determined ranges should not exceed 60%, preferably 10-60%, more preferably 20-50% of the final bar composition. The experimentally determined ranges are then used to determine a more specific range of each of the three components in the final bar and, at these then calculated ranges for the amount of each of the three components in the final bar, efflorescence is eliminated. Conversely, if using amounts outside the determined ranges for the three components when the calculation is done to determine the amount of each component to be used is final bar composition, efflorescence will likely be observed in a final bar. This is seen, for example, when comparing examples 3 and 4 to Comparative Examples D. E, and F.

According to the experiments noted which were used to determine the ranges for making the calculation, which in turn determines what the amount of each component in the final bar is, the range or ranges for making the calculation is or are as follows:

Experimentally Determined Ranges

| Water | Alkali metal isethionate (e.g., sodium isethionate) | Polyalkylene glycol (e.g., PEG) |
|---|---|---|
| 4%-27% | <8% | 68%-90% |

Thus, for example, if a formulation contained a combined total of 40% water, sodium isethionate and PEG total of the three components, the amount of sodium isethionate should not exceed 3.6%% of the final formulation (multiplication factor of 8%×40% total of the three components). Similarly, such final bar would comprise 27.2% (multiplication factor of 68%×40%) to 36% polyalkylene glycol and 1.6 (multiplication factor of 4%×40%) to 10.8% water (as well as 3.6% or less sodium isethionate) to ensure elimination of efflorescence in the final bar Applicants are aware of no reference which identifies specific ranges of water, alkali metal isethionate and polyalkylene glycol in specific syndet bars required to avoid efflorescence. There is also no reference that discloses or suggests use of a tool (experimentally determined ranges which are "multiplication factors") to define the critical amounts in the final bar needed to avoid efflorescence of each component.

U.S. Pat. No. 5,520,840 to Massaro, for example, discloses the use of water-soluble structurants within a specific range of melting points as well as defining surfactant levels and water insoluble structurants. The patent does not define syndet bar comprising critical levels of water, electrolyte polyalkylene glycol needed to eliminate efflorescence in such bars, or a tool to determine such.

U.S. Pat. No. 3,376,229 to Haas discloses incorporating between 4% and 7% of a bar composition with unesterified water-soluble alkali metal salts of isethionate acid (i.e., sodium isethionate). There is no teaching of avoiding efflorescence; of using bar composition comprising specific amounts of electrolyte, water-soluble structurants, and water; or of a method of determining the specific amounts needed.

U.S. Pat. No. 5,683,973 to Post et al. discloses incorporating low molecular weight polyalkylene glycols as processing aids, specifically for assisting extrusion. However, again, there is no teaching of bar comprising specific amounts of electrolyte, alkylene glycol and water or of using an experimentally determined range of the three to determine final bar amounts which will eliminate efflorescence.

U.S. Pat. No. 5,786,312 to Post et al. discloses a means to enhance clinical mildness of a syndet which includes a water-soluble structurant. There is no teaching of avoiding efflorescence; of using bar composition comprising specific amounts of electrolyte, water-soluble structurants, and water; or of a method of determining these specific amounts needed.

U.S. Pat. No. 5,795,852 to He discloses a means to enhance clinical mildness of a syndet which includes water-soluble structurant. There is no teaching of avoiding efflorescence; of using bar composition comprising specific amounts of electrolyte, water-soluble structurants, and water; or of a method of determining the specific amounts needed.

BRIEF SUMMARY OF THE INVENTION

Applicants have now quite unexpectedly found that specific synthetic detergent bars comprising specific amounts of polyalkylene glycol, alkali metal isethionate and water can eliminate efflorescence normally found in such bars. In a second form, they have found a method of determining the use of specific ranges (by determining and using experimentally determined ranges which act as "multiplication factors") of the three ingredients needed to avoid efflorescence.

The bars of the invention comprise:

a) 10% to 60% by wt. total bar synthetic surfactant;

b) 0% to 50% by wt. fatty acid and fatty acid soap wherein total fatty acid soap is less than 60% of the total surfactant (e.g., if using 20% synthetic, fatty acid soap is less than 12%)

c) 6.8% to 54%, preferably 13.6% to 45% water-soluble structurants (e.g., polyethylene glycol);

d) 0% to 4.8%, preferably 0.1 to 3.6%, preferably 0.1 to 3.0% alkali metal isethionate; and e) 0.4% to 16.2%, preferably 2.7% to 13.5% by wt. water.

The method of determining these amounts comprise preparing a ternary mixture of alkali metal isethionate, polyalkylene glycol and water, and determining (through visual observation) regions of single phase stability and homogeneity. The assessment is a simple visual assessment. It is noted that, as long as there are not two distinct liquid layers, then efflorescence will not form on the final product. A clear solution on its own will be stable, a turbid solution will be stable, but the presence of two distinct layers correlates with instability.

The experimental determined ranges (e.g., based on visual observations noted) which are used to calculate final amounts (e.g., by multiplying bars comprising 10% to 60%, preferably 20% to 50% total of the three components by these determined amounts, or "multiplication" factor) is as follows:

| Water | Alkali Metal Isethionate | Polyalkylene glycol |
|---|---|---|
| 4%-27% | <8% | 68%-90% |

Once the final formulation range is determined (using multiplication factor noted above and multiplying by total amount of the three components in final bar composition), bars may be prepared by mixing all ingredients as is well known by those in the art and extruding to form final bar product. It is noted that the person skilled in the art will select a sum of the three such that when multiplying by the experimentally determined factors, they will obtain where specifically in the final bar the amount of each of the three components should be.

DETAILED DESCRIPTION OF THE INVENTION

Except in the examples, or where otherwise explicitly indicated, all numbers in this description indicating amounts of material or conditions of reaction, physical properties of materials and/or use are to be understood as modified by the word "about." All amounts are by weight of the final composition, unless otherwise specified.

It should be noted that in specifying any range of concentration or amount, any particular upper concentration can be associated with any particular lower concentration or amount.

For the avoidance of doubt, the word "comprising" is intended to mean "including" but not necessarily "consisting of" or "composed of." In other words, the listed steps or options need not be exhaustive.

The disclosure of the invention as found herein is to be considered to cover all embodiments as found in the claims as being multiply dependent upon each other irrespective of the fact that claims may be found without multiple dependency or redundancy.

Final bar is prepared comprising:

a) 10% to 60% by wt. total bar synthetic surfactant;
b) 0% to 50%, preferably 5 to 45% by wt. fatty acid and fatty acid soap wherein total fatty acid soap is less than 60% of the total surfactant (e.g., if using 20% synthetic, fatty acid soap is less than 12%)
c) 6.8% to 54%, preferably 13.6% to 45% water-soluble structurants (e.g., polyalkylene glycol);
d) 0% to 4.8%, preferably 0.1 to 3.6%, preferably 0.1% to 3.0% alkali metal isethionate; and
e) 0.4% to 16.2%, preferably 2.7% to 13.5% by wt. water.

By water-soluble is meant that the structurant is dissolved to a substantially clear solution (except for small amounts of insoluble residue which may impart a translucent haziness to the otherwise clear solution) at 10% by wt. or greater of the structurant (e.g., starch) in water (i.e., at least 1 part in 10 should be soluble).

Synthetic surfactant means 'non-soap surfactant' in this description. Suitable synthetic surfactants of (a) are: alkyl ether sulphates; alkylethoxylates; alkylethoxycarboxylates; alkyl glyceryl ether sulphonates; alpha olefin sulphonates; acyl taurides; methyl acyl taurates; N-acyl glutamates; acyl isethionates; anionic acyl sarcosinates; alkyl phosphates; methyl glucose esters; protein condensates; ethoxylated alkyl sulphates; alkyl polyglucosides; alkyl amine oxides; betaines; sultaines; alkyl sulphosuccinates, dialkyl sulphosuccinates, acyl lactylates and mixtures thereof. The above-mentioned detergents are preferably those based upon $C_8$ to $C_{24}$, more preferably those based upon $C_{10}$ to $C_{18}$, alkyl and acyl moieties.

For many embodiments of this invention, the amount of synthetic surfactant (a) may lie in the range from 10 to 50% wt. Further preferences are at least 20% and not more than 40%, preferably not more than 35% by wt. Again, fatty acid soap is used in lesser amounts.

The formulations can contain up to 50% or so fatty acid and fatty acid soap, subject to caveat above that fatty acid soap be used in amounts less than amount of synthetic surfactant.

The water-soluble structurant is required to melt in the temperature range from 40° C. to 100° C. so that it can be melted to form the bar composition but will be in a solid state at temperatures at which the bar will be used. Preferably, it has a melting point of at least 50° C. to 90° C.

Materials which are envisaged as the water-soluble structurant (c) are moderately high molecular weight polyalkylene oxides of appropriate melting point and in particular polyethylene glycols or mixtures thereof.

Polyalkalene glycols (especially polyethylene glycols or PEGs) which are used typically have a molecular weight in the range 1,500-10,000. However, in some embodiments of this invention it is preferred to include a fairly small quantity of polyethylene glycol with a molecular weight in the range from 50,000 to 500,000, especially molecular weights of around 100,000. Such polyethylene glycols have been found to improve the wear rate of the bars. It is believed that this is because their long polymer chains remain entangled even when the bar compositions is wetted during use.

If such high molecular weight polyethylene glycols (or any other water-soluble high molecular weight polyalkylene oxides are used, the quantity is preferably from 1% to 5%, more preferably from 1% or 1.5% to 4% or 4.5% by weight of the composition. These materials will generally be used jointly with a larger quantity of other water-soluble structurant (c) such as the above mentioned polyethylene glycol of molecular weight 1,500 to 10,000.

Some polyethylene oxide polypropylene oxide block copolymers melt at temperatures in the required range of 40° to 100° C. and may be used as part or all of the water-soluble structurant (c). Preferred here are block copolymers in which polyethylene oxide provides at least 40% by weight of the block copolymer. Such block copolymers may be used, in mixtures with polyethylene glycol or other water-soluble structurant.

Preferably, the total quantity of water-soluble structurant (c) is from 6.8% to 54%, preferably 13.5% to 45% of the composition.

Hence, preferably the invention relates to a bar composition comprising:

a) 10% to 60% by wt. total bar synthetic (non-soap) surfactant;
b) 0% to 50% by wt. fatty acid and fatty acid soap wherein total fatty acid soap is less than 60% of the total synthetic surfactant;
c) 6.8% to 54% water-soluble structurant of the group consisting of
   polyalkylene oxides having a MW of 1,500-10,000,
   polyethylene oxide polypropylene oxide block copolymers,
   mixtures thereof and
   wherein the water soluble structurant optionally further comprises polyalkylene oxide, having a molecular weight in the range of 50,000 to 500,000 in an amount of 1 to 5% based on the weight of the composition, preferably polyalkylene glycol, preferably polyethylene glycol;
   wherein the water-soluble structurant has a melting point of 40 to 100° C., 0.1% to 4.8% alkali metal isethionate; and
d) 2.7% to 13.5% by wt. water, wherein the sum of water, alkali metal isethionate and said water-soluble structurant is 10% to 60% of the final bar composition, wherein based on the total amount of water, alkali metal isethionate and said water-soluble structurant,
   water is present in an amount of 4 to 27%,
   alkali metal isethionate is present in an amount of less than 8% and
   said water-soluble structurant is present in an amount of 68 to 90%.

The water-soluble structurant further comprises polyethylene glycol having a molecular weight in the range of 50,000 to 500,000 in an amount of 1 to 5%, preferably 1 to 4.5 wt %, more preferably 1.5 to 4 wt %, based on the weight of the composition. The amount is encompassed in the amount of water soluble structurant of 6.8 to 54%, as understood by the person skilled in the art. This would result in a preferred bar composition comprising:

a) 10% to 60% by wt. total bar synthetic (non-soap) surfactant;

b) 0% to 50% by wt. fatty acid and fatty acid soap wherein total fatty acid soap is less than 60% of the total synthetic surfactant;

c) 6.8% to 54% water-soluble structurant, of the group consisting of polyalkylene oxides having a MW of 1,500-10,000, polyethylene oxide polypropylene oxide block copolymers, mixtures thereof and wherein the water soluble structurant further comprises polyalkylene oxide, having a molecular weight in the range of 50,000 to 500,000 in an amount of 1 to 5% based on the weight of the composition, more preferably polyalkylene glycol, most preferably polyethylene glycol;

wherein the water-soluble structurant has a melting point of 40 to 100° C., 0.1% to 4.8% alkali metal isethionate; and d) 2.7% to 13.5% by wt. water, wherein the sum of water, alkali metal isethionate and said water-soluble structurant is 10% to 60% of the final bar composition, wherein based on the total amount of water, alkali metal isethionate and said water-soluble structurant, water is present in an amount of 4 to 27%, alkali metal isethionate is present in an amount of less than 8% and said water-soluble structurant is present in an amount of 68 to 90%.

The polyalkylene oxides having a molecular weight in the range of 1,500 to 10,000 preferably are polyalkylene glycol, resulting in a preferred bar composition comprising to a bar composition comprising:

a) 10% to 60% by wt. total bar synthetic (non-soap) surfactant;

b) 0% to 50% by wt. fatty acid and fatty acid soap wherein total fatty acid soap is less than 60% of the total synthetic surfactant;

c) 6.8% to 54% water-soluble structurant of the group consisting of polyalkylene glycol having a MW of 1,500-10,000, polyethylene oxide polypropylene oxide block copolymers, mixtures thereof and wherein the water soluble structurant further comprises polyalkylene oxide, having a molecular weight in the range of 50,000 to 500,000 in an amount of 1 to 5% based on the weight of the composition, more preferably polyalkylene glycol, most preferably polyethylene glycol;

wherein the water-soluble structurant has a melting point of 40 to 100° C., 0.1% to 4.8% alkali metal isethionate; and d) 2.7% to 13.5% by wt. water, wherein the sum of water, alkali metal isethionate and said water-soluble structurant is 10% to 60% of the final bar composition, wherein based on the total amount of water, alkali metal isethionate and said water-soluble structurant, water is present in an amount of 4 to 27%, alkali metal isethionate is present in an amount of less than 8% and said water-soluble structurant is present in an amount of 68 to 90%.

Polyalkylene oxides having a molecular weight in the range of 1,500 to 10,000 are preferably polyethylene glycol, resulting in a preferred bar composition comprising a) 10% to 60% by wt. total bar synthetic (non-soap) surfactant;

b) 0% to 50% by wt. fatty acid and fatty acid soap wherein total fatty acid soap is less than 60% of the total synthetic surfactant;

c) 6.8% to 54% water-soluble structurant of the group consisting of polyethene glycol having a MW of 1,500-10,000, polyethylene oxide polypropylene oxide block copolymers, mixtures thereof and wherein the water soluble structurant further comprises polyalkylene oxide, having a molecular weight in the range of 50,000 to 500,000 in an amount of 1 to 5% based on the weight of the composition, more preferably polyalkylene glycol, most preferably polyethylene glycol;

wherein the water-soluble structurant has a melting point of 40 to 100° C., 0.1% to 4.8% alkali metal isethionate; and d) 2.7% to 13.5% by wt. water, wherein the sum of water, alkali metal isethionate and said water-soluble structurant is 10% to 60% of the final bar composition, wherein based on the total amount of water, alkali metal isethionate and said water-soluble structurant, water is present in an amount of 4 to 27%, alkali metal isethionate is present in an amount of less than 8% and said water-soluble structurant is present in an amount of 68 to 90%.

Even more preferably, the invention relates to a bar composition comprising a) 10% to 60% by wt. total bar synthetic (non-soap) surfactant;

b) 0% to 50% by wt. fatty acid and fatty acid soap wherein total fatty acid soap is less than 60% of the total synthetic surfactant;

c) 6.8% to 54% of the water-soluble structurants polyethene glycol having a MW of 1,500-10,000, and optionally further polyethylene glycol having a molecular weight in the range of 50,000 to 500,000 in an amount of 1 to 5% based on the weight of the composition;

wherein the water-soluble structurant has a melting point of 40 to 100° C., 0.1% to 4.8% alkali metal isethionate; and d) 2.7% to 13.5% by wt. water, wherein the sum of water, alkali metal isethionate and said water-soluble structurant is 10% to 60% of the final bar composition, wherein based on the total amount of water, alkali metal isethionate and said water-soluble structurant, water is present in an amount of 4 to 27%, alkali metal isethionate is present in an amount of less than 8% and said water-soluble structurant is present in an amount of 68 to 90%.

Optionally, water insoluble structurants may be used, but are also required to have a melting point in the range 40° to 100° C., more preferably at least 50° C., notably 50° C. to 90° C. Suitable materials which are particularly envisaged are fatty acids, particularly those having a carbon chain of 12 to 24 carbon atoms. Examples are lauric, myristic, palmitic stearic, arachidonic and behenic acids and mixtures thereof. Sources of these fatty acids are coconut, topped coconut, palm, palm kernel, babassu and tallow fatty acids and partially or fully hardened fatty acids or distilled fatty acids. Other suitable water insoluble structurants include alkanols of 8 to 20 carbon atoms, particularly cetyl alcohol. These materials generally have a water solubility of less than 5 g/liter at 20° C.

The relative proportions of the water-soluble structurants and water insoluble structurants govern the rate at which the bar wears during use. The presence of the water insoluble structurant tends to delay dissolution of the bar when exposed to water during use and hence retard the rate of wear.

Water is present at levels of 0.4% to 16.2%, preferably 2.7 to 15.5% by wt. in the final bar.

WO95/12382 discloses a bar composition in Example 20 comprising

| Ingredient | Wt % |
|---|---|
| Coco lactobionamide | 40.00 |
| Sodium cocoyl isethionate | 15.00 |
| Palmitic stearic acid | 7.04 |
| PEG8000 | 29.35 |
| water | 5.00 |
| Misc. solids | 3.08 |
| Sodium isethonate | 0.53 |

This composition is therefore not desired to be part of the claimed subject matter. Coco lactobionamide is not preferred as a surfactant and preferably absent from the composition.

In a second form, the invention comprises a method of determining region where efflorescence is eliminated from bars comprising:

a) 10% to 60% by wt. total bar synthetic surfactant;
b) 0% to 50%, preferably 5 to 45% by wt. fatty acid and fatty acid soap wherein total fatty acid soap is less than 60% of the total surfactant (e.g., if using 20% synthetic, fatty acid soap is less than 12%)
c) 6.8% to 54%, preferably 13.6% to 45% water-soluble structurants (e.g., polyethylene glycol);
d) 0% to 4.8%, preferably 0.1 to 3.6%, preferably 0.1% to 3.0% alkali metal isethionate; and
e) 0.4% to 16.2%, preferably 2.7% to 13.5% by wt. water which method for calculating final range comprises multiplying the combined amount of water, alkali metal isethionate and polyalkylene glycol (where combined amount of the three in final bar is 10 to 60% of final bar) by the following amounts or ranges (also referred to as multiplication factor):

| Water | Alkali metal Isethionate (e.g., sodium isethionate) | PAGs |
|---|---|---|
| 4%-27% | <8% | 68%-90% |

It is noted that a person skilled in the art will understand how to pick suitable combinations of water, alkali metal isethionate and PEG within range of 10 to 60% to make bars which fall within the claim limitation ranges when multiplying by the factors we have identified. Thus, for example, choosing a combination of 60%, the minimum and maximum amount of PEG must be 41% and 54% respectively, based on the multiplication factor.

In a third form, the invention comprises a method of eliminating efflorescence in bars comprising synthetic surfactants, polyalkylene glycol and alkali metal isethionate, which method comprises formulating bars having the following composition:

a) 10% to 60% by wt. total bar synthetic surfactant;
b) 0% to 50%, preferably 5 to 45% by wt. fatty acid and fatty acid soap wherein total fatty acid soap is less than 60% of the total surfactant (e.g., if using 20% synthetic, fatty acid soap is less than 12%)
c) 6.8% to 54%, preferably 13.6% to 45% water-soluble structurants (e.g., polyethylene glycol);
d) 0% to 4.8%, preferably 0.1 to 3.6%, preferably 0.1% to 3.0% alkali metal isethionate; and
e) 0.4% to 16.2%, preferably 2.7% to 13.5% by wt. water.

wherein said method for calculating the final noted ranges comprises:

multiplying the combined amount of water, alkali metal isethionate and polyalkylene glycol (where combined amount of the three in final bar is 10 to 60% of final bar) by following amounts or ranges (also referred to as multiplication factor):

| Water | Alkali metal Isethionate | PAGs |
|---|---|---|
| 4%-27% | <8% | 68%-90% |

Hence the invention further relates to the use of water in an amount of 4 to 27%, alkali metal isethionate in an amount of less than 8% and water-soluble structurant in an amount of 68 to 90%, based on the weight of water, alkali metal isethionate and water soluble structurant taken together, for eliminating efflorescence in a bar composition comprising synthetic (non-soap) surfactant, polyalkylene oxide and alkali metal isethionate which method comprises formulating bar having the following composition:

a) 10% to 60% by wt. total bar synthetic surfactant;
b) 0% to 50% by wt. fatty acid and fatty acid soap wherein total fatty acid soap is less than 60% of the total synthetic surfactant.
c) 6.8% to 54% water-soluble structurants of the group consisting of
   a. polyalkylene oxides having a MW of 1,500-10,000,
   b. polyethylene oxide polypropylene oxide block copolymers,
   c. mixtures thereof and wherein the water soluble structurant optionally further comprises polyalkylene oxides having a molecular weight in the range of 50,000 to 500,000 in an amount of 1 to 5% based on the weight of the composition;

wherein the water-soluble structurant has a melting point of 40 to 100° C.,
d) 0.1% to 4.8% alkali metal isethionate; and
e) 2.7% to 13.5% by wt. water.

In such use according of the invention the polyalkylene oxides having a molecular weight in the range of 1,500 to 10,000 are preferably polyalkylene glycol, and most preferably are polyethylene glycol.

Further, the polyalkylene oxides having a molecular weight in the range of 50,000 to 500,000 are preferably polyalkylene glycol, and most preferably are polyethylene glycol.

EXAMPLES

Examples 1-2 and Comparatives A-C

The following ternary systems were prepared:

| | PEG | Water | SI | Visual observation |
|---|---|---|---|---|
| Comparative A | 68.61% | 13.52% | 17.88% | Multi-phase efflorescent |
| Comparative B | 68.61% | 22.44% | 8.95% | Multi-phase efflorescent |
| Example 1 | 68.61% | 26.91% | 4.48% | Stable and homogeneous |
| Comparative C | 81.88% | 7.53% | 10.59% | Multi-phase efflorescent |
| Example 2 | 89.81% | 4.38% | 5.81% | Stable and homogeneous |

These results were used to determine amounts of water, alkali metal isethionate and polyalkylene glycol which are critical to in turn determine amounts of each of the three in the final bar needed to eliminate efflorescence. The ranges for water (to use as "multiplication factor") were determined to be from 4 to 27%; for alkali metal isethionate, range was determined to be less than 8% (can be as high as 8.5%), preferably less than 7%, more preferably less than 6%; and for alkylene glycol range was determined to be 68 to 90%.

Examples 3-4 and Comparatives D, E and F

| Ingredients | Comparaitve D | Comparative E | Comparative F | Example 3 | Example 4 |
|---|---|---|---|---|---|
| Sodium Cocoyl Isethionate | 25.00% | 25.00% | 25.00% | 30.00% | 30.00% |
| Fatty acid (s) | 25.00% | 26.00% | 27.00% | 27.00% | 28.00% |
| Fatty acid soap (s) | 15.00% | 15.00% | 15.00% | 12.00% | 12.00% |
| PEG (s) | 20.00% | 20.00% | 20.00% | 20.00% | 20.00% |
| Sodium Cocoyl Betaine | 5.00% | 3.00% | 3.00% | 3.00% | 3.00% |
| Water | qs to 100% | qs to 100% | qs to 100% | qs to 100% | qs to 100% |
| Sodium Isethionate | 5.00% | 5.00% | 5.00% | 2.30% | 1.80% |
| salt, colorant, preservative | <2.0% | <2.0% | <2.0% | <2.0% | <2.0% |
| Efflorescence | Yes | Yes | Yes | No | No |

The above formulations 3 and 4 comprise amounts of water, alkali metal isethionate and polyalkylene glycol formulation within required range of the invention and demonstrated no efflorescence. In particular, it will be seen that Examples 3 and 4 have 2.30% and 1.80%, respectively of sodium isethionate and do not demonstrate efflorescence. By contrast, Comparatives D, E and F have 5.0% sodium isethionate (above the 4.8% limit of our claimed composition) and these show efflorescence.

The invention claimed is:

1. A bar composition comprising:

a) 10% to 60% by wt. total bar synthetic non-soap surfactant;

b) 27 to 28% by wt. fatty acid and 12% by wt. fatty acid soap wherein total fatty acid soap is less than 60% of the total synthetic surfactant;

c) 6.8% to 54% water-soluble structurant, selected from of the group consisting of polyalkylene oxides having a MW of 1,500-10,000, polyethylene oxide polypropylene oxide block copolymers, mixtures thereof and wherein the water soluble structurant further comprises polyalkylene oxides having a molecular weight in the range of 50,000 to 500,000 in an amount of 1 to 5% based on the weight of the composition, wherein the amount is encompassed in the amount of water soluble structurant of 6.8 to 54%, wherein the water-soluble structurant has a melting point of 40 to 100 ° C.;

d) 0.1% to 4.8% alkali metal isethionate; and e) 2.7% to 13.5% by wt. water, wherein the sum of water, alkali metal isethionate and said water-soluble structurant is 10% to 60% of the final bar composition, wherein based on the total amount of water, alkali metal isethionate and said water-soluble structurant, water is present in an amount of 4 to 27%, alkali metal isethionate is present in an amount of less than 8% and said water-soluble structurant is present in an amount of 68 to 90%.

2. The bar composition according to claim 1, wherein said water soluble structurant is present at level of 13.6% to 45% by wt.

3. The bar composition according to claim 1, wherein said water-soluble structurant further comprises polyalkylene oxides having a molecular weight in the range of 50,000 to 500,000 in an amount of 1 to 4% based on the weight of the composition.

4. The bar composition according to claim 1, wherein the polyalkylene oxides having a molecular weight in the range of 1,500 to 10,000 are polyalkylene glycol.

5. The bar composition according to claim 1, wherein the polyalkylene oxides having a molecular weight in the range of 1,500 to 10,000 are polyethylene glycol.

6. The bar composition according to claim 1, wherein the polyalkylene oxides having a molecular weight in the range of 50,000 to 500,000 are polyalkylene glycol.

7. The bar composition according to claim 1, wherein the polyalkylene oxides having a molecular weight in the range of 50,000 to 500,000 are polyethylene glycol.

8. The bar composition according to claim 1, wherein polyethylene oxide polypropylene oxide block copolymers comprise more than 40% by wt of polyethylene oxide.

9. A composition according to claim 1, wherein alkali metal isethionate is sodium isethionate.

10. The bar composition according to claim 1, wherein:

water is present in an amount of 4 to 27%, alkali metal isethionate is present in an amount of less than 8% and water-soluble structurant is present in an amount of 68 to 90%, based on the weight of water, alkali metal isethionate and water soluble structurant taken together, wherein efflorescence is eliminated.

11. The bar composition according to claim 10, wherein the alkali metal isethionate is sodium isethionate.

12. The bar composition according to claim 10, wherein the polyalkylene oxides having a molecular weight in the range of 1,500 to 10,000 are polyalkylene glycol.

13. The bar composition according to claim 10, wherein the polyalkylene oxides having a molecular weight in the range of 50,000 to 500,000 are polyalkylene glycol.

14. The bar composition according to claim 12, wherein the polyalkylene oxide is polyethylene glycol.

15. The bar composition according to claim 13, wherein the polyalkylene oxide is polyethylene glycol.

16. The bar composition according to claim 1, wherein the bar composition demonstrates no efflorescence when formed into a bar.

17. The bar composition according to claim 1, wherein the bar composition contains no visible crystals when formed into a bar.

* * * * *